United States Patent [19]

Haiduk

[11] Patent Number: 4,694,883

[45] Date of Patent: Sep. 22, 1987

[54] HOLLOW CORE MOLDING APPARATUS

[75] Inventor: Klaus Haiduk, Cologne, Fed. Rep. of Germany

[73] Assignee: Klöckner-Humboldt-Deutz AG, Cologne, Fed. Rep. of Germany

[21] Appl. No.: 810,551

[22] Filed: Dec. 18, 1985

Related U.S. Application Data

[63] Continuation of Ser. No. 456,279, Jan. 6, 1983, abandoned.

[30] Foreign Application Priority Data

Jan. 7, 1982 [DE] Fed. Rep. of Germany ..... 3200193

[51] Int. Cl.[4] ..... B22C 9/10; B22C 9/12; B22C 13/12

[52] U.S. Cl. ..... 164/186; 164/228; 164/232; 164/267

[58] Field of Search ..... 164/267, 28, 44, 232, 164/228, 172, 173, 182, 186, 187, 207, 211, 213

[56] References Cited

U.S. PATENT DOCUMENTS 3,633,651 1/1972 Ruhlandt ..... 164/267

FOREIGN PATENT DOCUMENTS 1173618 7/1964 Fed. Rep. of Germany ..... 164/228
2437997 2/1976 Fed. Rep. of Germany ..... 164/44
643778 9/1950 United Kingdom ..... 164/228

*Primary Examiner*—Nicholas P. Godici
*Assistant Examiner*—Samuel M. Heinrich
*Attorney, Agent, or Firm*—Becker & Becker, Inc.

[57] ABSTRACT

An apparatus for producing a hollow foundry core, whereby core halves are first formed and fully hardened on an inner hollow-mold part and an outer mold-box half. These core halves are then sprayed with an adhesive and joined to form a finished foundry core. The apparatus reduces the production costs and improves the accuracy as to the size of the cores. The forming of the core halves on a center plate and the bringing together of the core halves respectively occurs by moving together both core-box halves in one operation.

1 Claim, 4 Drawing Figures

HOLLOW CORE MOLDING APPARATUS

This is a continuation of co-pending parent application of U.S. Ser. No. 456,279-Haiduk filed Jan.6, 1983, now abandoned.

BACKGROUND OF THE INVENTION

The present invention relates to a method of producing a hollow foundry core from two core halves; each core half is formed on an inner hollow-mold part and an outer core-box half; the core halves are subsequently joined together.

FIELD OF THE INVENTION

During the production of castings, required recesses or hollow chambers are generally produced by providing cores in the mold. These cores are intended to disintegrate substantially after the casting so as to avoid core removal work and not hinder or prevent the casting contraction. To attain this goal, but also to save costly core sand material, foundry cores are internally recessed or hollowed out to the extent that their geometrical shape and the production procedure employed permit doing so. Thus there exists, for example, the possibility of producing a one-piece core, which is internally hollowed out, by having a fixed or movable mandrel or core bar enter the mold sand during the molding procedure; the mandrel or core bar is withdrawn from the core after the mold sand has set. Disadvantageous in doing so is that in this manner no core can be produced which has uniform wall thickness; consequently, no uniform hardening or setting of the formed core is possible. Additionally, the finished core has an opening which must be closed by other mold parts during the later casting procedure, since otherwise casting melt would penetrate into the interior of the core.

2. Description of the Prior Art

German Offenlegungsschrift No. 17 58 959 provides for forming two core halves on two corresponding mold machines, whereby each molding machine has a core-box half and a hollow mold part fastened to lifting cylinders. In a first step, the two core halves are produced on the molding machine; then the two core-box halves, together with the core halves remaining therein, are transported to an assembly station. Here the core-box halves are stacked and are pressed together by means of a pressing tool or die, so that the respective core halves are connected with each other. This method is very costly or complex because of the different operations. Furthermore, the accurate alignment of the two core-box halves is very difficult; thus it cannot be avoided that the accuracy as to size of the cores suffers, which means a backfill or material can enter between the core halves, or an overall dimension of the core is attained by pressing the core halves together which does not correspond to the desired dimension.

It is therefore an object of the present invention to avoid the previously described difficulties, and to provide a method and an apparatus with which the production of optimally recessed hollow cores is possible via hollow mold parts in a single operation.

BRIEF DESCRIPTION OF THE DRAWINGS

This object, and other objects and advantages of the present invention, will appear more clearly from the following specification in connection with the accompanying drawings, in which.

SUMMARY OF THE INVENTION

Figure 1:
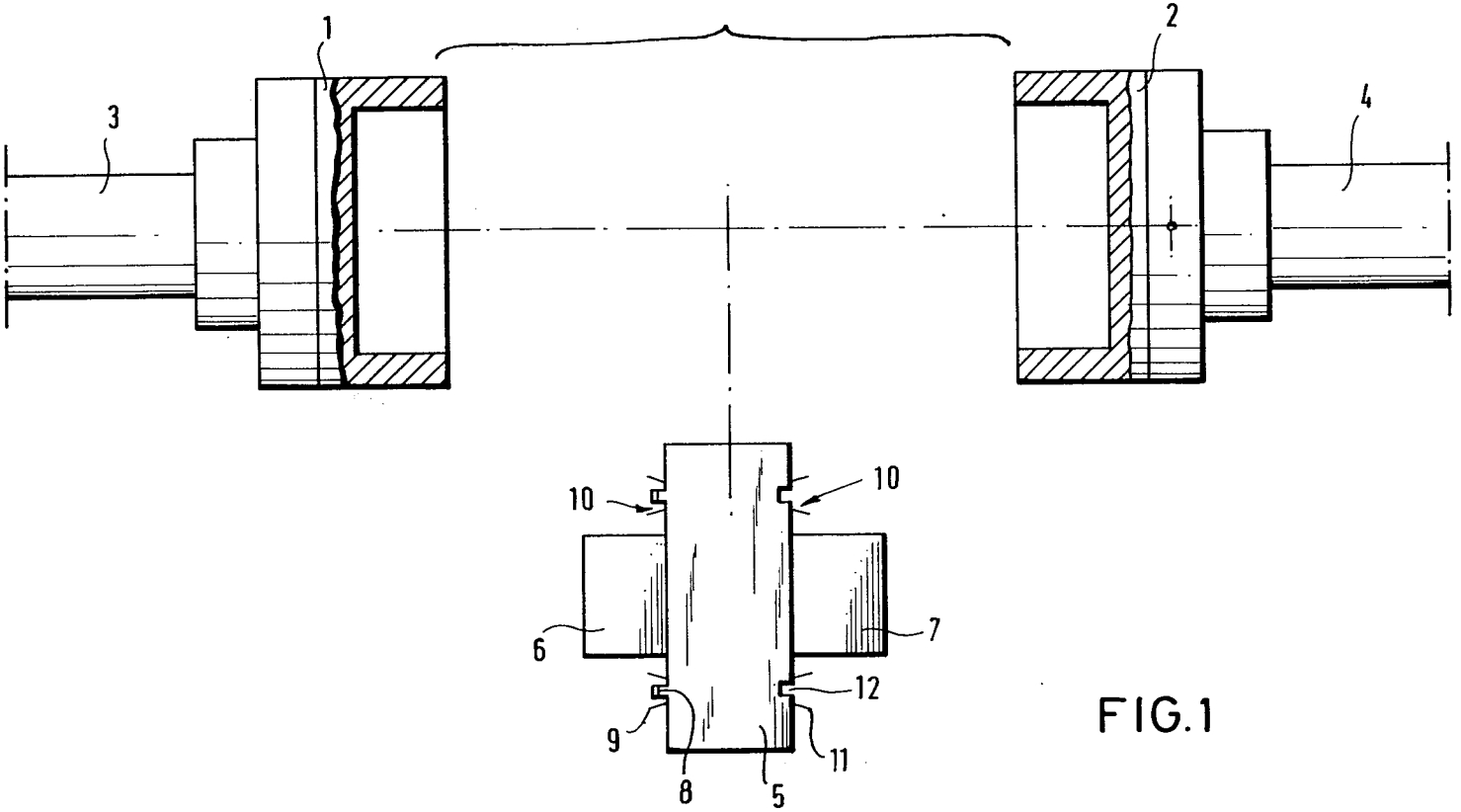
FIG. 1 is a schematic partial longitudinal section of one inventive embodiment showing the two halves of the core box moved apart, and the center plate, at the beginning of the method of the present invention.

The method of the present invention is characterized primarily by the following steps:

(a) moving, pivoting, or bringing-in a center plate, which has hollow-mold parts on both sides thereof, into a location between the core-box halves, which are spaced from one another;

(b) moving or bringing together the core-box halves until the core-box halves enclose or surround the hollow-mold parts and rest against the center plate;

(c) blowing or charging the mold sand into the core-box halves, and hardening or setting the mold sand by introducing gas and/or heating the core-box halves and/or the center plate;

(d) separating or moving apart the core-box halves, together with the respectively formed core halves, and pivoting out or withdrawing the center plate with the hollow-mold parts from the space or chamber between the core-box halves;

(e) joining or bringing together the core halves by bringing together the core-box halves; and (f) conveying the finished core, after ejection or withdrawal from one of the core-box halves, by means of the other core-box half onto a table or other repository, or a conveyor belt, and subsequently ejecting the core from this other core-box half.

As a result, a complete hollow foundry core can be produced on one machine in a single operation which comprises several sub steps. The dimensional accuracy of the foundry core which can be obtained is very high at a small cost for the control of the method, since the core-box halves maintain their aligned position during the entire production process. Only the center plate, which has hollow-mold parts on both sides, at the beginning and after termination of the molding process, must be pivoted into or out of this alignment. In this manner, hollow foundry cores can be produced which have a uniform wall thickness and a connection location free of any attachments.

Additionally, it is especially advantageous if elements of a clamping or holding connection, e.g. elements which cooperate in pairs, are installed automatically or manually on both sides of the center plate prior to pivoting the center plate between the two core-box halves. During subsequent filling or charging of the core-box halves, these elements project into the core sand and anchor themselves during the hardening or setting. The element fastened on the connection surface of one of the mold halves catches in the element of the other mold half during subsequent moving or bringing together of the core halves, and the core halves are immovably fastened to one another in this manner. However, there also exists the possibility of automatically or manually applying a quick-hardening adhesive to the connection surface of at least one of the core halves prior to bringing the core halves together.

However, as proposed in another embodiment according to the present invention, special profiled members, e.g. holding connection elements of sand, can also be formed in or on the connection surface of the core halves directly during the molding process by means of mold parts arranged on the end faces of the center plate. These profiled members cooperate in pairs during subsequent bringing together of the core halves in that the profiled members immovably fasten the core halves to one another.

The two core-box halves may be moved in a horizontal or transverse direction to form and bring together the core, while one of the core-box halves may be pivoted 90° for conveying the core.

In a further development according to the present invention, an apparatus is proposed for carrying out the described method. This apparatus is characterized primarily by fastening the mold-box halves on hydraulic or pneumatic cylinders in such a way that they are aligned in a horizontal or vertical plane. These cylinders move the core-box halves on both sides against the center plate, which is pivoted or moved into the alignment by a support, prior to filling with the core sand.

Both of the end faces of the center plate may have oppositely located and aligned recesses and projections into or onto which the respective elements of the holding connection can be inserted in pairs.

Furthermore, special types of holding connections are proposed for arrangement in bores on both end faces of the center plate It is advantageous to have these holding connections constructed according to the principle of a snap fastener; i.e., one element has a projecting part which catches in a correspondingly shaped resilient recess during bringing together of the mold halves. However, there also exists the possibility, according to the principle of a Morse taper-shank connection, of arranging one element having an outer cone on one side of the center plate, and arranging an element with an inner cone on the other oppositely located side of the center plate. When the core halves are brought together, the element with the outer cone anchored in one core half catches in the element with the inner cone anchored in the other core half. The position of the two core halves can be fixed very precisely relative to one another in this manner.

A spray device may be arranged on a support, and may be pivoted between the core halves for applying an adhesive.

DESCRIPTION OF A PREFERRED EMBODIMENT

Referring now to the drawings in detail, FIGS. 1 to 4 illustrate two core-box halves 1 and 2 which together serve to form the outer contour of the core that is to be produced. These two core-box halves 1 and 2 are each fastened to the end of a piston rod 3 or 4 of a hydraulic cylinder (not illustrated in further detail). A center plate 5 is also shown which is fastened to a support 16 shown in FIG. 4 along with an adhesive spray device 17 also carried thereby. Hollow-mold parts 6 and 7 are disposed on the end faces of the center plate 5. Additionally, one of the end faces of the center plate 5 has several projections 8 disposed about the hollow-mold part 6; these projections 8 serve to receive elements 9 of a holding or clamping connection 10. Recesses 12 are provided on the other end face of the center plate 5, and are located exactly opposite the projections 8; these recesses 12 serve to receive elements 11 of the connection 10.

FIG. 1 illustrates the arrangement in the normal or starting position; i.e., the two core-box halves 1 and 2 are separated or moved apart via the piston rods 3 and 4, and the center plate 5, which is already equipped with the elements 9 and 11 of the connection 10, has not yet been moved between the two core-box halves 1 and 2.

Figure 2:
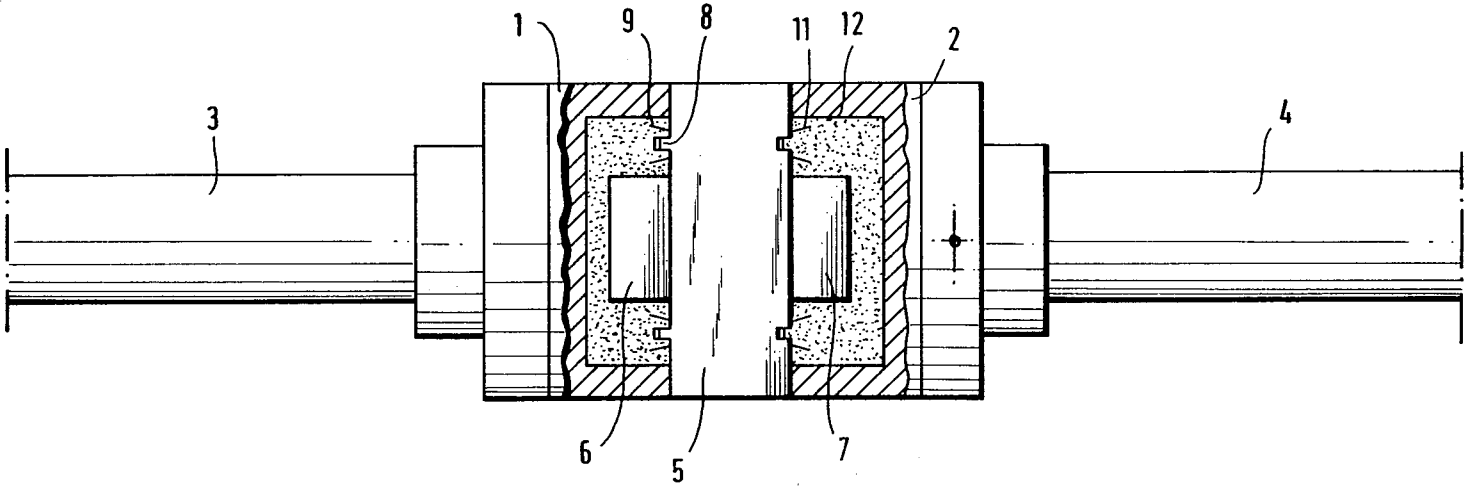
FIG. 2 schematically illustrates an arrangement after the core-box halves have been moved together on the center part, and after shooting-in or filling-in the mold sand has been blown in or charged.

In FIG. 2, the support has already moved or pivoted the center plate 5 between the two core-box halves 1 and 2, and the core-box halves 1 and 2 have been moved toward one another via the piston rods 3 and 4, so that the core-box halves 1 and 2 surround the hollow-mold parts 6 and 7, and their ends rest against the center part 5. Additionally, in FIG. 2, the mold sand has already been introduced into the space or chamber between the core-box half 1, the hollow-mold part 6, and the center part or plate 5 on the one hand, and between the core-box half 2, the hollow-mold part 7, and the center part or plate 5 on the other hand.

Figure 3:
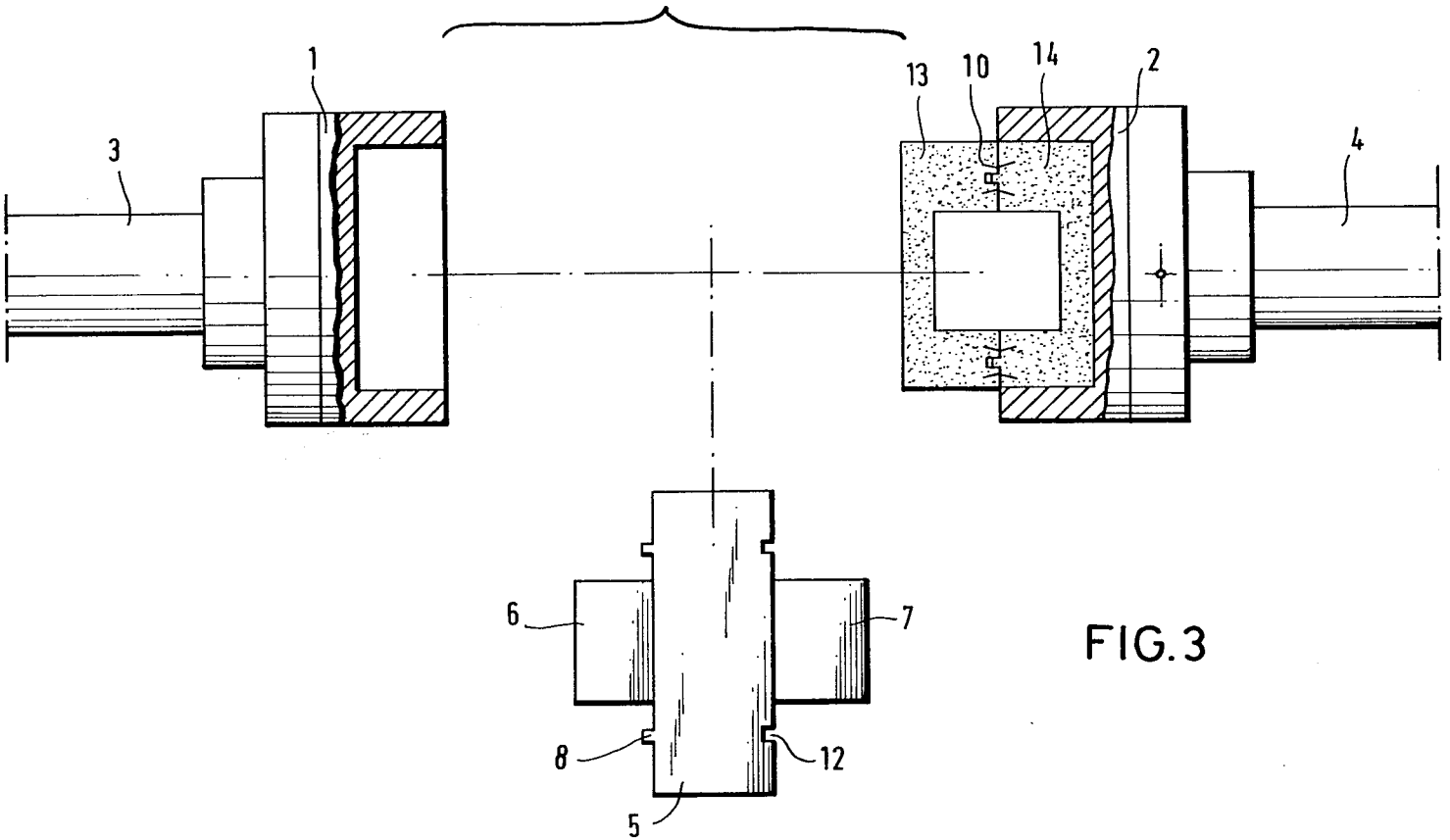
FIG. 3 schematically shows an arrangement where the finished core is held by one half of the core box after removal of the center plate and the joining or bringing together of the core halves.

FIG. 3 shows the arrangement in that stage of the inventive method in which, after the core-box halves have been moved apart together with the core halves hardened or cured therein, and the center plate 5 between the core-box halves 1 and 2 has been pivoted or swung out, the core halves 13 and 14 have been joined together on the elements 9 and 11 of the connection 10 by moving together the core-box halves 1 and 2, and the core-box half 1 has been removed from the finished core. The core-box half 2 holds the finished core, which comprises the core halves 13 and 14, and pivots the same, as apparent from FIG. 4, to release it after it is deposited on a table or other repository 15, or a conveyor belt. The finished core now is available for use in a mold.

The method according to the present invention can be used with all known mechanical cold or hot core production processes.

The method described in the foreign German Patent No. 1173618—Röper of July 1964 may seem to be similar to the method according to the present invention. However, the present inventive method has many additional inventive features over and beyond that of the foreign German Patent No. 1173618. In the foreign German Patent No. 1173618—Röper, there is noted that in a manner analogous to the method of the present invention before the filling-in or injection of the mold sand into the core-box halves between the core-box halves kept spaced from each other at the beginning (FIG. 4 of German Patent No. 1173618) there is a center plate introduced, which on two sides respectively has hollow forming parts. Likewise, there is noted that here the core-box halves are brought together until these halves engage against the hollow forming parts or against the center plate. Furthermore, there occurs the sequence of movement of the core-box halves preferably in horizontal direction.

An essential difference with respect to the method according to the present invention exists in the production of the part-cores themselves and the subsequent connection thereof. With the method according to the foreign German Patent No. 1173618 there is noted that collectively or all together, the hollow-forming parts are so structured that the part-core halves are over dimensioned at the dividing surfaces to be joined. These over dimensioned regions are marked in FIGS. 1 to 3 with diagonal dashes. This over dimensioning occurs exclusively for the purpose to be able to press together the part-core halves as far as to the finished final measurement or dimension, whereby the mold sand of the dividing surfaces is mixed. So that, however, in doing so there can be attained an immovable connection between the part-core halves, special method steps are necessary during curing or hardening procedure of the mold sand. After the filling-in of the mold sand in a first method step there is started with the hardening process, whereby after a predetermined time interval, this hardening process is interrupted. During this hardening process, the regions of the part-core halves are to be hardened, which adjoin the model contour or shape of the core-box halves, which means those regions which are remote or away from the structured or over dimensioned dividing surfaces. According to this first hardening process, the center plate is then moved out of the previously separated core-box halves and then the core halves are brought together so far that the part-cores are joined at the over dimensioned dividing surfaces thereof under a high pressure. In doing so, the inner contours of the dividing surfaces penetrate into each other thereby being compressed to the final finished dimension or measure. Thereafter the interrupted hardening process is continued, until also the compressed dividing surfaces of the part-core halves are completely hardened.

The method or procedure of the foreign German Patent No. 1173618—Röper incorporates grave or serious disadvantages. Thus, in spite of the high apparatus cost for control of the different hardening processes, there is in no way any capability to produce a finished hollow core with the necessary dimensions or tolerances. This is attributable thereto on the one hand that after interruption of the first hardening process with subsequent removal of the center plate and joining of the part-core halves, there is unavoidable a thermal distortion of the part-core halves during the unavoidably occurring cooling-off process herewith. Furthermore, there exists the danger, that during the joining of the part-core halves under pressure that mold material discharges or escapes along the lateral peripheral surfaces of the part-core halves, which form or mold material as beads or waves permanently influences the holding of size or dimension or makes the same unusable. Additionally, there is also encountered the danger of splitting-apart of the part-core halves during the joining under pressure, since in practice the first hardening process is not controllable so accurately, that with certainty there is precluded that partial or part-regions of the dividing surfaces of the part-core halves do not also harden. This, however, unavoidably has the consequence that the region hardened in the dividing surfaces no longer could be compacted or compressed anymore with the oppositely located dividing surfaces but rather here, because of the over dimension, the same would penetrate like a wedge into the part-core halves and destroY the same.

In comparison there is noted that the present inventive method, makes provision that before the removing movement of the center plate that the two part-core halves are completely hardened and thereupon being connected again by means of quick-hardening adhesive. Hereby there is noted that the danger of a thermal distortion or warping is precluded because of the uninterrupted hardening process as far as to the complete hardening also for the dividing surfaces of the part-core halves. A compacting or compressing or a penetration of mold-sand portions within the dividing surfaces during the connection procedure does not occur with the method according to the present invention, since the two part-core halves are formed in the core-box halves and are formed engaging or adjoining to the hollow-mold parts of the center plate. After the application of the adhesive mass, it is therefore also not necessary with the inventive method to bring the part-core halves into engagement against each other under a high pressure. There is completely adequate and sufficient, to bring the core-box halves so far together until these halves engage each other securely. This occurs substantially pressureless.

According to the present invention, the finished hollow core after the pressing-out from the core-box halves is transported to a delivery location by means of other core-box halves subsequent to pressing-out from a core-box half by means of the other core-box half.

Also according to the present invention, clamping connections are employed exclusively in combination with the rapidly hardening adhesive; there is noted that the clamping connection can serve as fixing elements, the same in contrast to the clamping connections previously known having to contribute only an extremely nominal amount to the connection of the core halves.

According to the present invention, hardened mold sands are subsequently connected with each via a rapidly-hardening adhesive. A spraying device can be employed during the production of hollow casting cores and with that for a generic apparatus according to the present invention. The present inventive apparatus is to operate exclusively with completely hardened mold sand.

Figure 4:
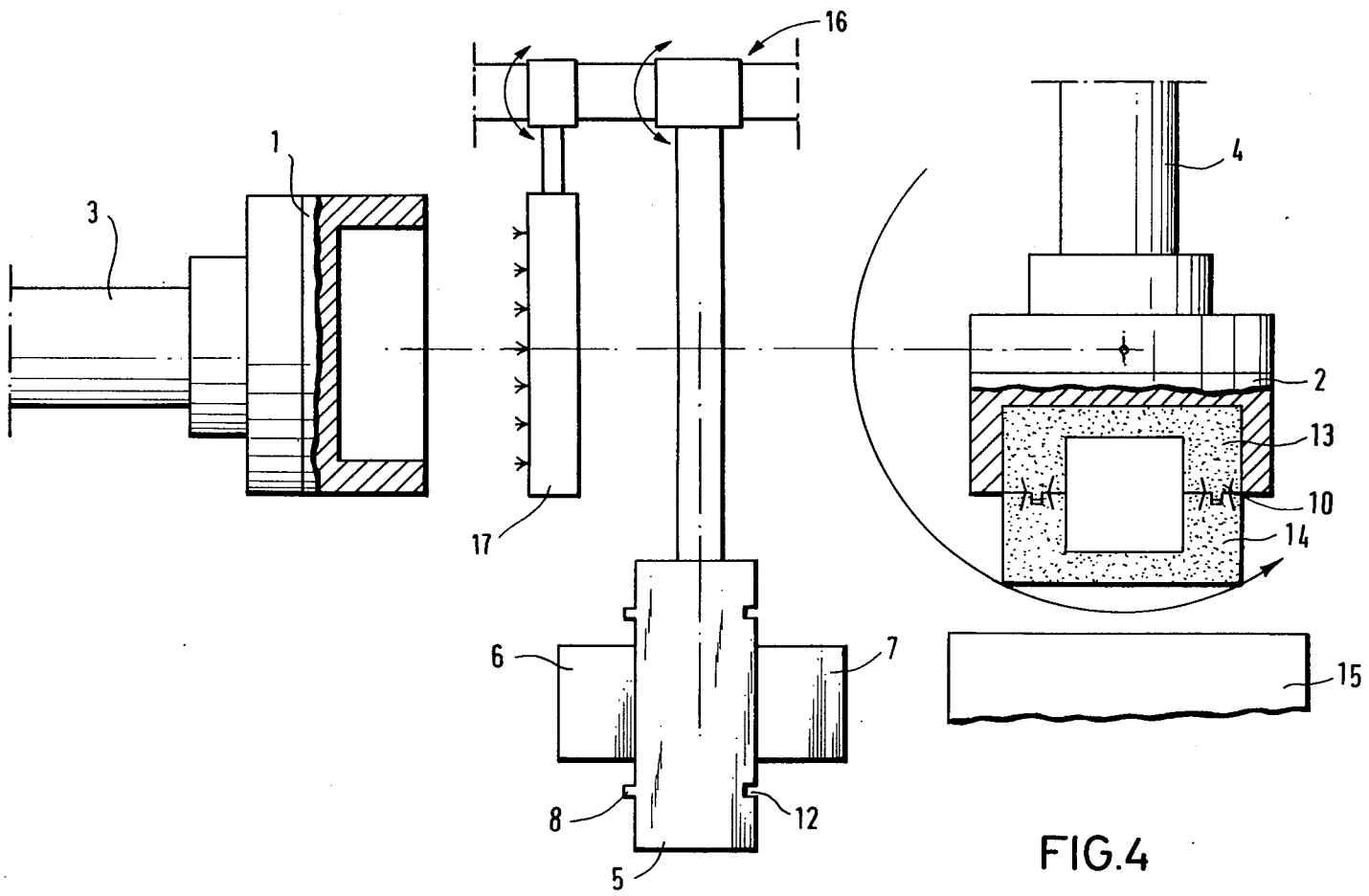
FIG. 4 schematically shows an arrangement after pivoting of one of the core-box halves and before ejection of the finished foundry core onto, e.g., a table or other collection or conveying means.

The foreign German Patent No. 1173618—Röper in no way shows recesses or projections in FIG. 2 or along the contours of the plates into which the elements of the clamping connections are insertable according to the present invention and there is noted only the shape or contour of the plate as a structure which is to represent over dimension regions of the dividing surfaces of the part-core halves. FIG. 4 schematically illustrates the spraying device and the tool carriers.

As a supplement to the functional description with respect to FIGS. 1 through 4 inclusive in the present inventive disclosure, there can be noted that the core-box halves 1 and 2 fastened on the hydraulic cylinders 3 and 4 in FIG. 1 are illustrated in the starting position before making the apparatus operational, respectively representing the present inventive method. Reference numeral 5 generally designates the middle plate which is apparent from FIG. 4, being fastened pivotally in the direction of arrow means on a common tool carrier or support 16 of the apparatus. On the end faces of the middle plate 5 there are arranged respectively a hollow-mold part 6 and 7, which when rendering operative or putting apparatus into operation forms the hollow chamber or space within the core half. The middle plate 5 has several projections 8 and recesses 12 on the end faces thereof in order to form projections or recesses of hardened-out mold material likewise at the connection surfaces or junctures of the core halves. As already set forth the apparatus in FIG. 1 is found in the starting position, so that the two core-box halves 1 and 2 are moved apart via the piston rod respectively hydraulic cylinder means 3 or 4 and the middle plate 5 has not yet been pivoted between the two core-box halves 1 and 2.

The middle plate 5 is pivoted via the connection rod of the middle plate 5 (see FIG. 4) pivotally arranged on the tool carrier during putting into operation of the apparatus whereby the middle plate 5 is pivoted between the core-box halves 1 and 2 kept spaced from each other. After that, the core-box halves are shifted in the direction of the middle plate 5 by means of the hydraulic cylinder 3 or 4 until the core-box halves fit or engage completely against the middle plate 5. This is illustrated in FIG. 2. Thereafter, a warm hardenable mold material is filled into the hollow space or chamber between the core-box halves 2 respectively 1 and the middle plate 5 respectively hollow-mold parts 6 and 7. As is very clearly apparent from FIG. 2, clamping connections are formed in the core halves by the filled-in warm hardenable mold material through the projections 8 and the recess 12 on the middle plate 5. Thereafter, the core halves 1 and 2 are heated so long until the mold material of the two core halves including the recesses or projections thereof on the connection surfaces are completely hardened-out or cured. Up to this moment or up to this point in time there is noted that the position of the middle plate 5, core-box halves 1, 2 and so forth correspond to the condition illustrated in FIG. 2.

After the hardening-out of the two core halves in the respective core-box halves 1 and 2, the core-box halves 1 and 2 are moved so far apart via the hydraulic cylinder means 3 and 4, that the middle plate 5 can be pivoted away or out of position by means of the tool carrier or support 16. Thereby the middle plate 5 including the hollow-mold parts 6 and 7 thereof as well as the projections 8 and recesses 12 occupy the position thereof illustrated in FIG. 4. Thereafter, a spray device 17 is pivoted by means of the tool carrier or support 16 relating to one of the core halves, as illustrated in FIG. 4, and the connection surface or joint of this core half in the core-box half 1 is provided with a rapidly or quick-hardening adhesive. After the rapidly or quickly-hardening adhesive is sprayed upon the connection surface, thereupon the spray device 17 is removed or pivoted out again from the plane of the core-box half 1 by means of the tool carrier or support 16.

Thereafter, the core half is found in a condition such that the core half can be connected with the other core half. For that, the core-box halves 1 and 2 are brought or moved together again with the respective core halves located therein and moreover, so far until the core halves engage against each other. The projections, respectively recesses formed out of the hardened-out mold material, serve thereby for a secure centering of the core halves. After the connection of two core halves, the core-box half 1 now lifts from the finished or produced core via a moving-in movement of the hydraulic cylinder means 3, as apparent from the drawing illustration according to FIG. 3. The core-box half 2, which now carries the finished core including the core halves 13 and 14 connected with each other, then pivots around 90° in a direction upon a place of deposit, table or repository 15. The hydraulic cylinder means 4 then moves or travels in the direction of the place of deposit, table or repository 15 and places the finished or produced core upon this place of deposit, table or repository 15, which has a conveyer belt as apparent from the illustration of FIG. 4. This conveyer belt of the plate of deposit, table or repository 15 leads to a station within a casting or foundry operation or plant, in which the finished foundry or casting core is stored or is to be used. There is believed that the foregoing specification also can be taken to set forth the means for ejecting the finished core along with the supply of the mold sand being clarified in the foregoing description.

The following paragraphs set forth summary of the features of the method and apparatus of the present invention.

The present invention relates to a method for production of a hollow casting or foundry core of hardenable, especially warm hardenable mold sands, via two core halves, with which every core half is formed on an inner hollow-mold part and outer core-box half characterized by combination of the following method steps:

- before the filling-in or supplying of the mold sand there is holding of the core-box halves with spacing from each other;
- a middle plate is moved or introduced between the core-box halves being held with spacing from each other, which middle plate on both sides thereof has hollow-mold parts;
- the core-box halves are moved so far against the middle plate, until the core-box halves surround the hollow-mold parts of the middle plate and engage against the middle plate;
- the hardenable mold sand is filled into the core-box halves;
- by means of the mold parts provided on the end faces of the middle plate, there is forming respectively along the connection surfaces of the core halves elements of clamping connections cooperating in pairs made of the hardenable mold sands;
- the entire mold material of the core halves including the elements of clamping connections cooperating in pairs formed of the mold sand is subjected to being completely hardened-out;
- the core-box halves together with the respectively shaped or molded core halves are moved apart and thus the middle plate with the hollow-mold parts is moved out of the space between the core-box halves;
- after the moving-out of the middle plate, there is applying of a rapidly or quickly hardening adhesive upon the connection surfaces of the core halves;
- the connection surfaces of the core-halves to be adhered are brought into engagement by moving together the core-box halves, whereby the cooperating elements of clamping connections of hardened-out mold sand interengage; and
- the finished core is moved or forced out of one core-box half by means of the other core-box half and thereupon being transported from this core-box half to a point of deposit or repository with subsequent ejection.

The method according to the foregoing is further characterized thereby that one core-box half after horizontal pressing-out movement of the finished core from the other core-box half completes a pivot movement around 90° for transporting of the finished core to the point of deposit or repository.

The apparatus for performing the method according to the foregoing to mold core halves of hardenable mold sands out of two hollow core halves, with which every core half is formed or molded respectively on a middle plate having an inner hollow-mold part and an outer core-box half, whereby the core halves are fastened in alignment in a horizontal plane with a spacing from each other on hydraulic- or pneumatic cylinder means, whereby the middle plate providing the inner hollow-mold parts is fastened on a tool carrier or support, and including a spray device, which is arranged on the same tool carrier as the middle plate, whereby the spraying device is pivotable between the core halves hardened-out in the core-box halves and serving for application of a quickly or rapidly hardening adhesive, and whereby the middle plate on the two end faces thereof has oppositely located and aligned recesses respectively projections, which serve to form clamping connections within the mold material of the core halves.

The foregoing apparatus is further characterized thereby that the clamping connections on the one hand have an element with an outer cone and on the other hand having an element with an inner cone or taper.

There is significant that with the present invention, before the joining of the core halves that the warm-hardenable mold material is completely hardened-out. There is necessary that the core halves and not the core-box halves are to be hardened-out. Such a hardening-out of the core-box halves naturally would not be entirely correct to consider without distinguishing from evaluating in any manner the complete hardening-out of the core halves.

Attention is directed to the fact that the features of the present invention have extraordinary meaning from a technical and economical standpoint. Also, there must be set forth and expressed very clearly that before the retraction or removal of the middle plate, that the mold material is to be entirely hardened-out. Also, attention is to be directed thereto that the clamping elements now are to consist exclusively of hardened-out mold material. Thus, the feature that the clamping elements should consist of separate special clamping structural parts can be considered to be eliminated from consideration. Means for supplying of mold material and means for ejecting the finished core are to be considered to exist herewith although no further detailed illustration thereof is provided.

With the procedure or method according to the foreign German Patent No. 1173618 of Röper there is noted that the connection of the individual core halves occurs thereby that these are hardened-out only partially up to the joining thereof. The surface of the core halves to be connected is. still soft accordingly. Because of the over-dimensioned dividing or separating surfaces of the two core halves, there is accordingly possible to press these soft non-hardened-out regions together bv means of pressure, so that the two core halves can enter into a close connection. Not until thereafter is there brought to an end the hardening-out process. There should be apparent that hereby along the connection location there can emerge seams and beads, which during subsequent hardening-out process result in an unchangeable outer shape of the finished hollow core. If then, such a hollow core is employed for decanting or casting of a work piece, with that there is left much to be desired so far as the accuracy to size of this workpiece is concerned.

In contrast to the foregoing, there is respectfully noted with the procedure or method according to the present invention that the mold material is hardened-out completely before joining of the core halves, so that the disadvantages of the foreign German Patent No. 1173618 of Röper are completely eliminated and overcome. Detailed statements as to these differences and advantages attainable with the present invention can be found in the foregoing description along with the distinctions and overcoming of disadvantages with respect to dimensional tolerances when employing the features of the present invention in comparison with those of the foreign German Patent No. 1173618 of Röper.

A foreign French Patent No. 2,361,955-Jernverks discloses a method for production of hollow core halves, with which special plastic-connection-elements are inserted or employed in the respective dividing or separating surfaces. These plastic-connection elements are adhesively joined with each other for connection of the core halves. Accordingly, with that there must be noted that contrary to the present inventive disclosure, an adhesive is not applied upon the separating or dividing surface of the core halves itself but rather such adhesive is applied only upon the upper or surface regions of the plastic-connection elements and there must be doubted that hereby any close connection of the two core halves is attainable at all.

In accordance with the present inventive method on the one hand, the respective core halves are shaped or formed together with the elements of clamping connections cooperating in pairs in a forming or molding procedure using the hardened-molding sand engaging or joining the middle plate; and on the other hand accordingly the entire molding material is to be hardened completely, collectively including the clamping-connection elements formed of the molding sand, before the core-box halves are removed from the middle or central plate.

With that there now should be made clear and understandable that before or prior to the moving-out of the middle or central plate, both of the two partial core halves including collectively and entirely therewith the clamping connection elements are completely hardened and before or prior to the joining or bringing together in this completely hardened-out condition, the same are connected with quick-hardening adhesive. The decisive advantage of these features, according to the present invention, compared with the state of the art is that via the engaging of the core halves against the middle or central plate and the remaining thereof in the core-box halves during the entire hardening-out procedure, there is precluded a thermal distortion during the hardening-out procedure occurring under effect or influence of temperature thereon. Additionally, the quickly or rapidly hardening adhesive can be applied upon the hardened solid or rigid dividing surface with the clamping connection elements provided therewith in the same manner as upon a solid or rigid material including for example wood, and then joined like solid or rigid material in core halves and adhered with each other accordingly without being displaced or moved. There is apparent that via these inventive method steps that cores can be produced which maintain dimensions or tolerances to the utmost and which additionally require only smaller nominal apparatus cost and complexity.

In summary, there can be attention directed to the following features of the present invention.

(1) A method for production of two hollow casting or foundry core of hardened-out or cured mold sands especially cured or hardened-out by heat, via two core halves, with which each core half is shaped or formed by an inner hollow mold part and an outer core-box half, characterized by a combination of the following method steps:

Before the introduction or filling-in of the mold sand into the core-box halves there is noted that these core-box halves are held with spacing from each other;

A middle or central plate is moved or introduced between the core-box halves held with spacing from each other, such middle or central plate on each of two sides thereof having hollow-mold parts;

The core-box halves are moved so far to the middle or central plate until the core-box halves surround the hollow-mold parts of the middle or central plate and engage against the middle or central plate;

The cured or hardened-out mold sand is filled into the core-box half, the core halves are shaped or formed by means of the hollow-mold parts of the middle or central plate and of the core-box halves, whereby clamping-connection elements are formed out of the hardened-out or cured mold sand via mold parts provided on the face sides of the middle or central plate of the provided mold parts respectively on the subsequent connection surfaces of the core halves, such clamping connection elements cooperating in pairs;

The entire mold material of the core halves including collectively the elements of the clamping connection cooperating in pairs as formed out of the mold sand being hardened-out or cured in entirety in a position in which the core-box halves still engage completely against the middle or central plate, before the core-box halves together with the respectively shaped or formed core halves and connection elements cooperating in pairs are moved apart;

After the moving apart of the core-box halves, the middle or central plate with the hollowmold parts is moved out of the space between the core-box halves;

After the moving out of the middle or central plate there is applying or application of a quickly or rapidly hardening adhesive directly upon the connection surfaces of the core halves;

The connection surfaces of the core halves to be adhered are brought into engagement by bringing together of the core-box halves whereby the elements of the clamping connections cooperating with each other that are made of cured or hardened-out mold sand engage into each other;

The finished or completed core is moved or forced out of the one core-box half by means of the other core-box half and then the finished or completed core is transported to a depot, warehouse or place of deposit with subsequent ejection from this core-box half, whereby the one core-box half after the horizontal discharge movement of the finished or completed core out of the other core-box half completes a pivot movement about 90° for transporting of the finished or completed core to the place of deposit.

(2) An apparatus for carrying out the method of (1) for molding or shaping of core halves out of hardened-out mold sands out of two hollow core halves with which each core half is molded on a middle or central plate having inner hollow-mold parts and an outer core-box half employed therewith, whereby the core halves are fastened in alignment with spacing from each other in a horizontal plane on hydraulic-or pneumatic cylinder means or actuators, whereby the middle or central plate having the inner hollow-mold parts is fastened on a tool carrier, and with a spray device, which is arranged movably on a same or identical tool carrier on the middle or central plate in that the spray device is pivotable between the core-box halves held with spacing from each other collectively with the core-halves hardened-out or cured therein and serving for applying or application of a quickly or rapidly hardening adhesive and whereby the middle or central plate on the two face sides thereof has recesses and projections in alignment and located opposite to each other which serves for molding or forming of clamp connections on the core halves out of cured or hardened-out mold material, whereby the clamping connections on the one hand provide an element with an outer cone and on the other hand an element with an inner cone.

The present invention is, of course, in no way restricted to the specific disclosure of the specification and drawings, but also encompasses any modifications within the scope of the appended claims.

What I claim is:

1. An apparatus for molding core halves out of mold sands comprising two core-box halves, each core half being molded on a center plate having inner hollow-mold parts and a respective outer core-box half employed therewith, and the core-box halves are fastened in alignment with spacing from each other in a horizontal plane on actuator cylinder means, and the center plate having the inner hollow-mold parts is fastened on a tool carrier, and a spray device and the center plate are arranged movably on the same tool carrier, said spray device being pivotable between the core-box halves held with spacing from each other collectively with the core-halves therein, said spray device serving for application of a hardening adhesive directly on faces of the core halves, said center plate on the two face sides thereof having recesses and projections in alignment and located opposite to each other and which serve for molding of clamp connections on the core halves out of mold material, said core halves being cured or hardened-out in the core-box halves before the core-box halves are moved apart and said center plate is removed, and said spray device after application of the hardening adhesive on faces of the core halves then being pivotable away from between the core-box halves which are then brought together into engagement with each other along with the core halves still located in the core-box halves so that the core halves thereupon adhered to each other are kept from deformation, and dimensioning thereof is maintained to the utmost in the finished unit.

* * * * *